US008944345B2

(12) United States Patent
Huang

(10) Patent No.: US 8,944,345 B2
(45) Date of Patent: Feb. 3, 2015

(54) SWING SPRINKLER

(75) Inventor: Tzu-Lin Huang, Changhua (TW)

(73) Assignee: Sunny Bird Enterprise Co. Ltd., Changhua (TW)

( * ) Notice: Subject to any disclaimer, the term of this patent is extended or adjusted under 35 U.S.C. 154(b) by 601 days.

(21) Appl. No.: 13/355,523

(22) Filed: Jan. 21, 2012

(65) Prior Publication Data

US 2013/0186978 A1 Jul. 25, 2013

(51) Int. Cl.
*B05B 3/02* (2006.01)

(52) U.S. Cl.
USPC ..... 239/230; 239/222.11; 239/222.17; 239/225.1; 239/231

(58) Field of Classification Search
USPC ..... 239/214, 222.11–222.17, 225.1, 230, 239/231, 233, 251, 252, 253, 255, 261, 505, 239/516, 517
See application file for complete search history.

(56) References Cited

U.S. PATENT DOCUMENTS 3,009,650 A * 11/1961 Alvarez ..... 239/230
4,173,306 A * 11/1979 Ridgway ..... 239/230
4,497,441 A * 2/1985 Chow ..... 239/230
4,978,070 A * 12/1990 Chow ..... 239/230
5,209,404 A * 5/1993 Jun ..... 239/230

* cited by examiner

*Primary Examiner* — Jason Boeckmann
(74) *Attorney, Agent, or Firm* — Che-Yang Chen; Law Office of Michael Chen

(57) ABSTRACT

A swing sprinkler includes a main body, a driving unit, a cover body, an inner plate and an action unit. The tightness of a resilient unit can be adjusted by the user through the action unit, and a secured positioning is formed by the engagement of restricting protruding ribs of the inner plate and positioning protruding ribs of the receiving space to prevent the resilient unit from rewinding after adjustment to effectively adjust the tightness of the resilient unit and swing unit, and increase variability, as well as practicability and convenience of the sprinkler.

5 Claims, 8 Drawing Sheets

SWING SPRINKLER

FIELD OF THE INVENTION

The present invention relates to a swing sprinkler, and more particularly to a swing sprinkler that the user can adjust the tightness of a resilient unit and rebounding speed of a swing unit in the sprinkler.

BACKGROUND OF THE INVENTION

Today, sprinklers are often used for automatic water spraying and irrigating. The sprinkler is usually coupled with the water source, and the water strikes an arm of a swing unit of the sprinkler to achieve the goal of water spraying. The swing unit usually has a spring, so when the arm of the swing unit is struck by water, it can restore using the resilient force provided by the spring and obtain a circular spraying area to further achieve the goal of irrigation. However, conventional sprinklers may have the following drawbacks: (a) the swing unit of the conventional sprinkler uses the resilient force provided by the spring to restore, and is struck by water to spray. However, the spring has an elastic coefficient, and it is difficult t o adjust the tightness through the sprinkler, so the rebounding speed of the swing unit cannot be enhanced by rewinding the spring, and the spraying cannot be concentrated after the swing unit is struck by water. If the water is sprayed to an area with concentrated planting, the water cannot be averagely and effectively distributed to the plants in the area; and (b) the spring in the conventional sprinkler is easily to become fatigue after being used for a certain period of time, so the rebounding speed of the swing unit is reduced, and the speed cannot be increased after the swing unit is struck by water, so that the water cannot precisely strike the swing unit to cause uneven and ineffective water spraying. If the user wants to fix the problem, he/she has to uninstall the sprinkler to replace the spring or replace the sprinkler, which is inconvenient and not cost-effective.

SUMMARY OF THE INVENTION

The problem to be solved in the present invention is (a) the swing unit of the conventional sprinkler uses the resilient force provided by the spring to restore, and is struck by water to spray. However, the spring has an elastic coefficient, and it is difficult t o adjust the tightness through the sprinkler, so the rebounding speed of the swing unit cannot be enhanced by rewinding the spring, and the spraying cannot be concentrated after the swing unit is struck by water. If the water is sprayed to an area with concentrated planting, the water cannot be averagely and effectively distributed to the plants in the area; and (b) the spring in the conventional sprinkler is easily to become fatigue after being used for a certain period of time, so the rebounding speed of the swing unit is reduced, and the speed cannot be increased after the swing unit is struck by water, so that the water cannot precisely strike the swing unit to cause uneven and ineffective water spraying. If the user wants to fix the problem, he/she has to uninstall the sprinkler to replace the spring or replace the sprinkler, which is inconvenient and not cost-effective.

To solve the problems illustrated above, the present invention provides a swing sprinkler has a main body, a driving unit, a cover body, an inner plate and an action unit. A space is formed at an upper portion of the main body, and a swing unit is correspondingly formed. A ring portion is formed at an upper portion of the space, and a positioning slot is formed on both sides of the ring portion and facing each other. A center axis is protrudingly formed at a center portion of the swing unit, and a positioning hole is formed one side of the center axis. A resilient unit is disposed on the center axis, and an upper positioning stick and a lower positioning stick are protrudingly formed at an upper and lower portion of the resilient unit, and the lower positioning stick passes through the positioning hole. A protruding portion is formed at a bottom portion of the driving unit and engaged with the center axis of the swing unit. A non-circular connecting stick extends from an upper portion of the driving unit, and a cone-shaped protruding end is protrudingly formed at an upper portion of the connecting stick, and a resilient gap is formed from the protruding end at the upper portion to the lower portion of the connecting stick. A connecting board extends from one side of the driving unit, and a fixed hole is formed through the connecting board to form a secured positioning with the upper positioning stick of the resilient unit. A cover body covers the ring portion of the upper portion of the space, and a wedging protruding block is formed on both sides of the inner wall of the positioning slot on both sides of the ring portion. A receiving space is recessedly formed at the upper portion of the cover body, and a through hole is formed and provided for the connecting stick of the driving unit to protrudingly pass through. Also, a plurality of positioning protruding ribs are formed at an outer periphery of an inner bottom surface of the cover body. The inner plate is disposed in the receiving space on top of the cover body, and a center portion of the inner plate has a non-circular through opening that is disposed onto the connecting stick of the driving unit. A plurality of restricting protruding ribs are formed at periphery of the bottom portion of the inner plate, corresponding to the positioning protruding ribs of the receiving space, disposed between the positioning protruding ribs of the receiving space. The action unit is disposed on top of the cover body, and a non-circular positioning trough is recessedly formed at a center portion of the action unit, and a wedging hole is formed and through upwards. When the action unit is connected with the cover body, the positioning trough is disposed onto the connecting stick of the driving unit, so that the protruding end passes through the wedging hole to connect with each other and form a secured positioning.

Comparing with conventional faucets, the present invention is advantageous because the main body has a structure to adjust the tightness of the resilient unit and the rebounding speed of the swing unit according to the status of the sprinkler, so when the water strikes the swing unit, the water spraying status can be adjusted to either concentrated or scattered. Furthermore, when the adjustment takes place, it can be achieved by merely rotating the action unit of the main body to simultaneously drive the inner plate to use the restricting protruding ribs to engage with positioning protruding ribs of the receiving space to form a secured positioning to prevent the resilient unit from rewinding after adjustment to achieve the goal of effectively adjusting the tightness of the resilient unit and the rebounding speed of the swing unit. Therefore, the spraying status of the sprinkler has more variabilities, and the sprinkler is more practical and convenient to use.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
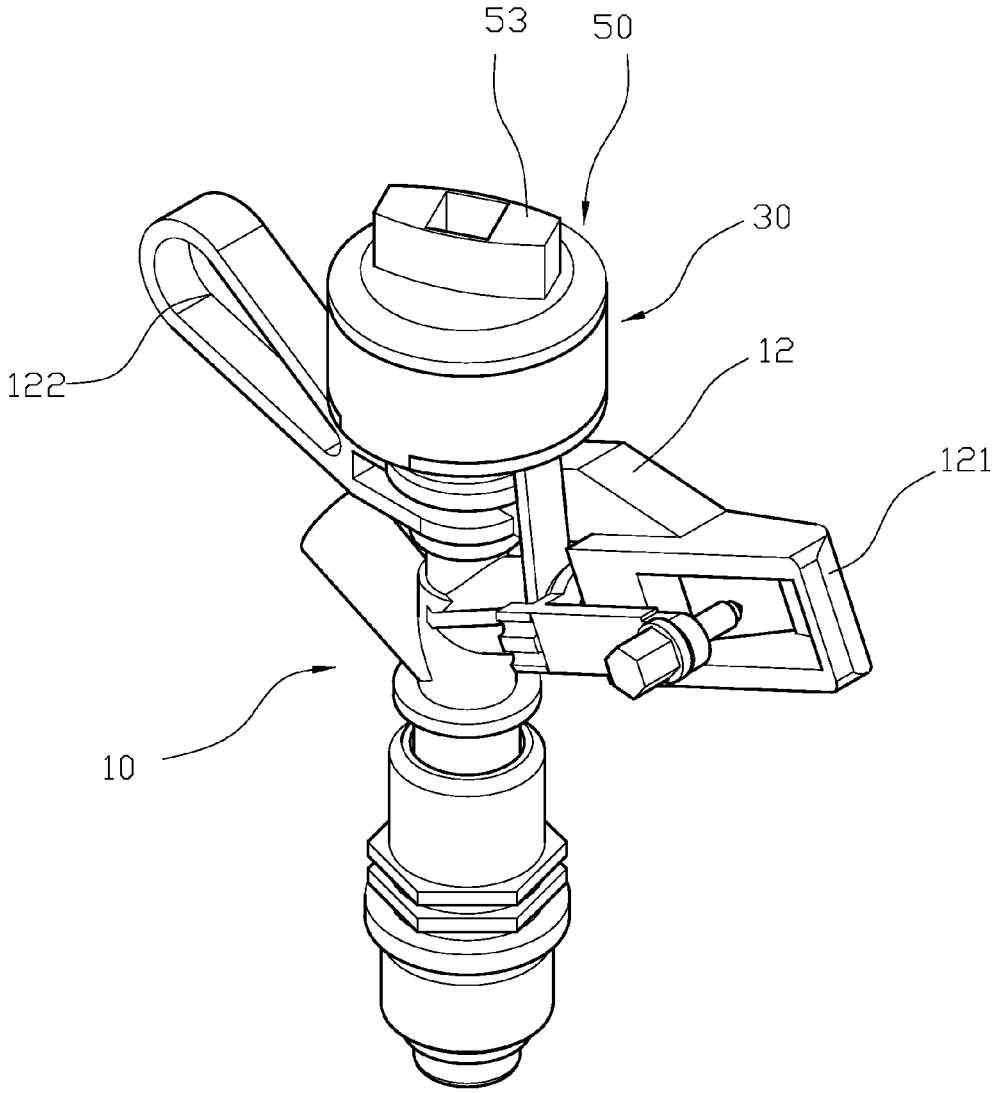
FIG. 1 illustrates a three-dimensional view in the present invention.
Figure 2:
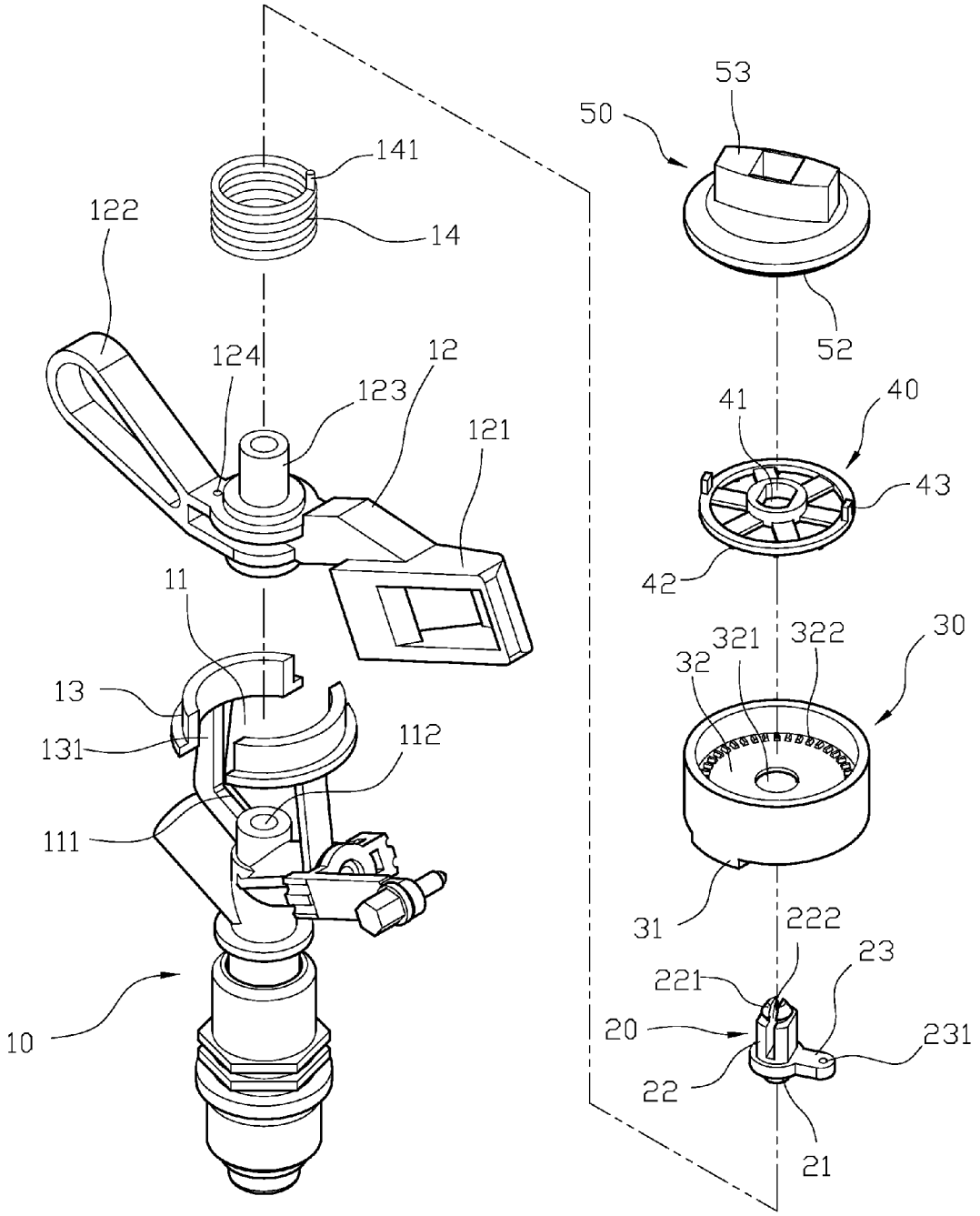
FIG. 2 illustrates a three-dimensional exploded view in the present invention.
Figure 3:
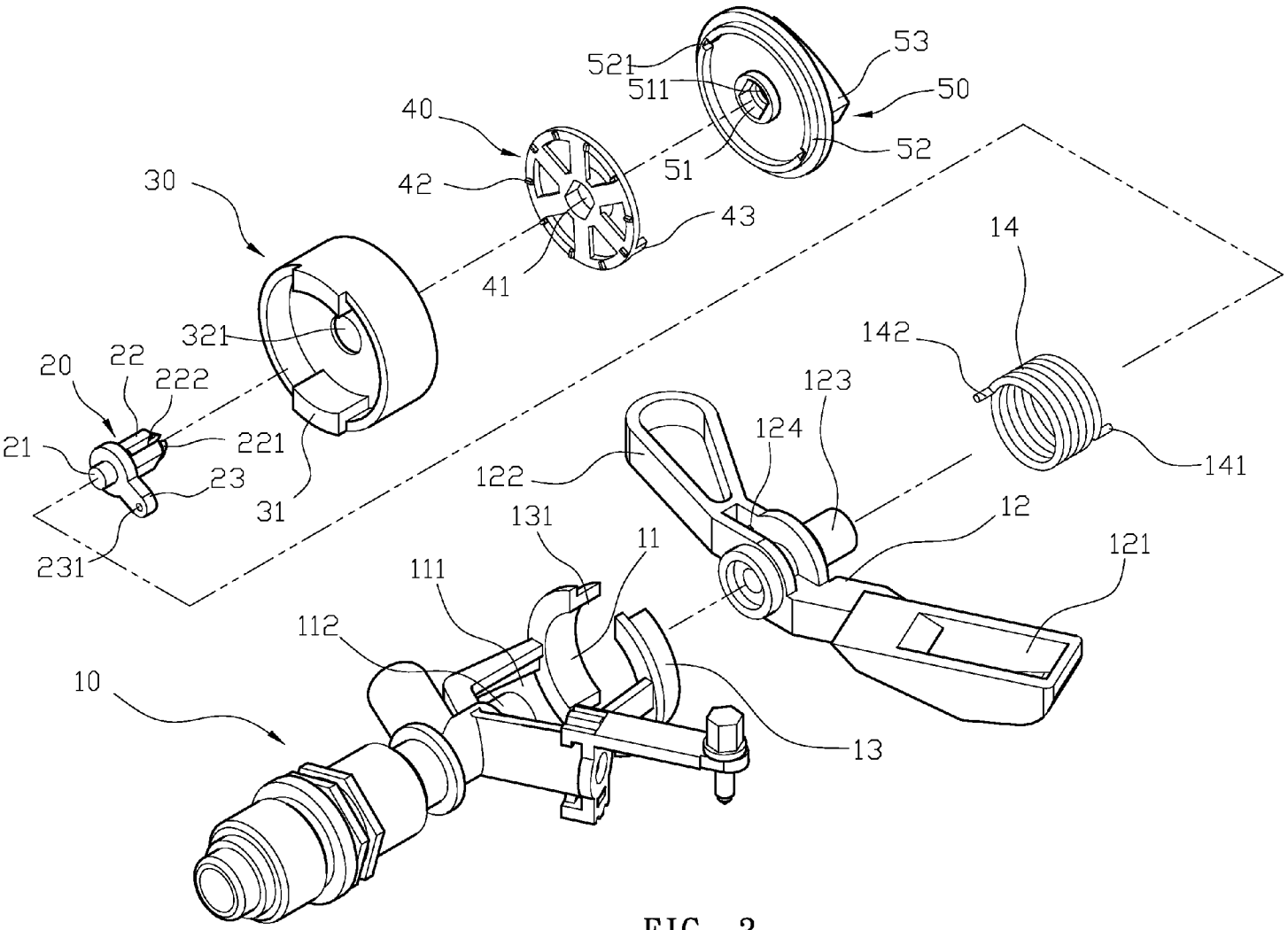
FIG. 3 illustrates an exploded view of another view angle in the present invention.
Figure 4:
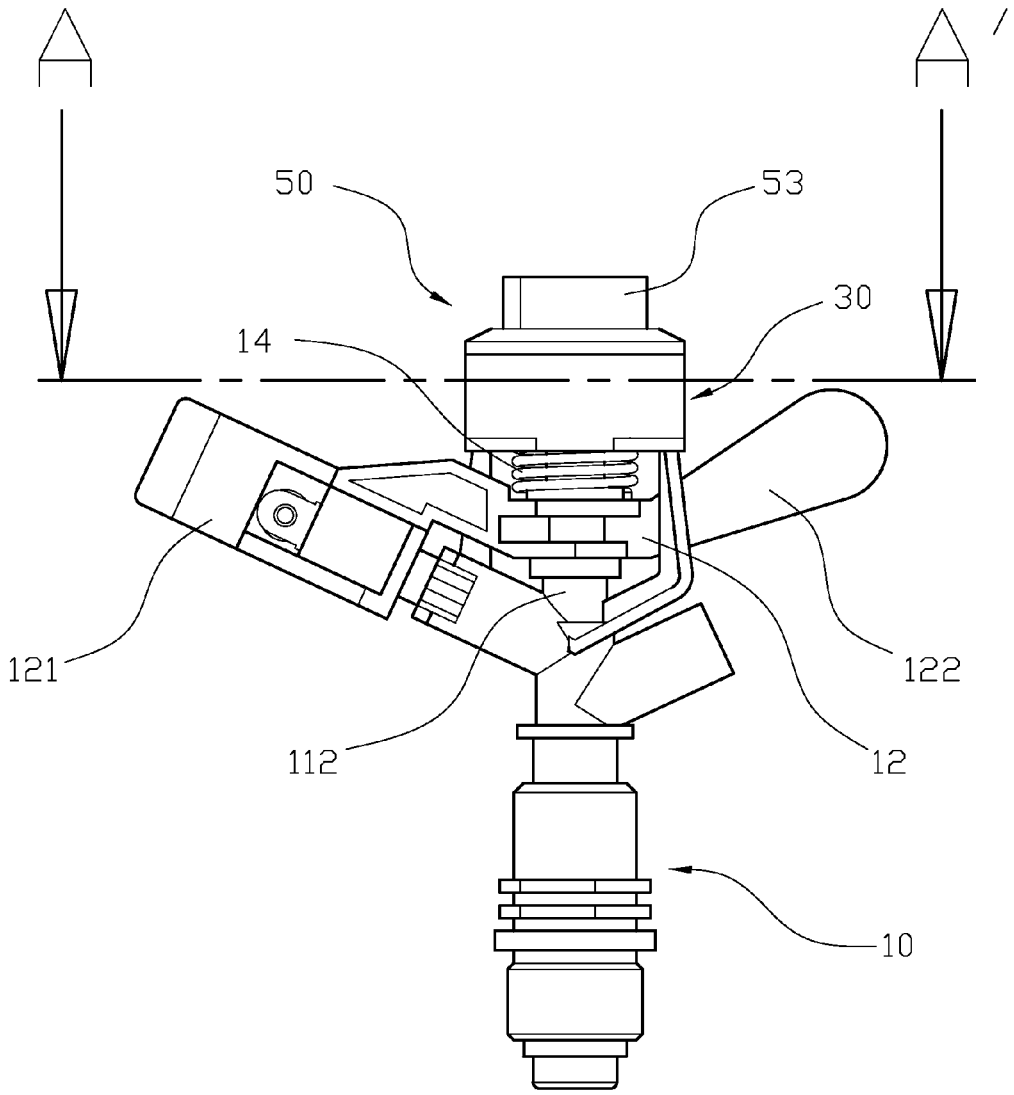
FIG. 4 illustrates a two-dimensional schematic view in the present invention.
Figure 5:
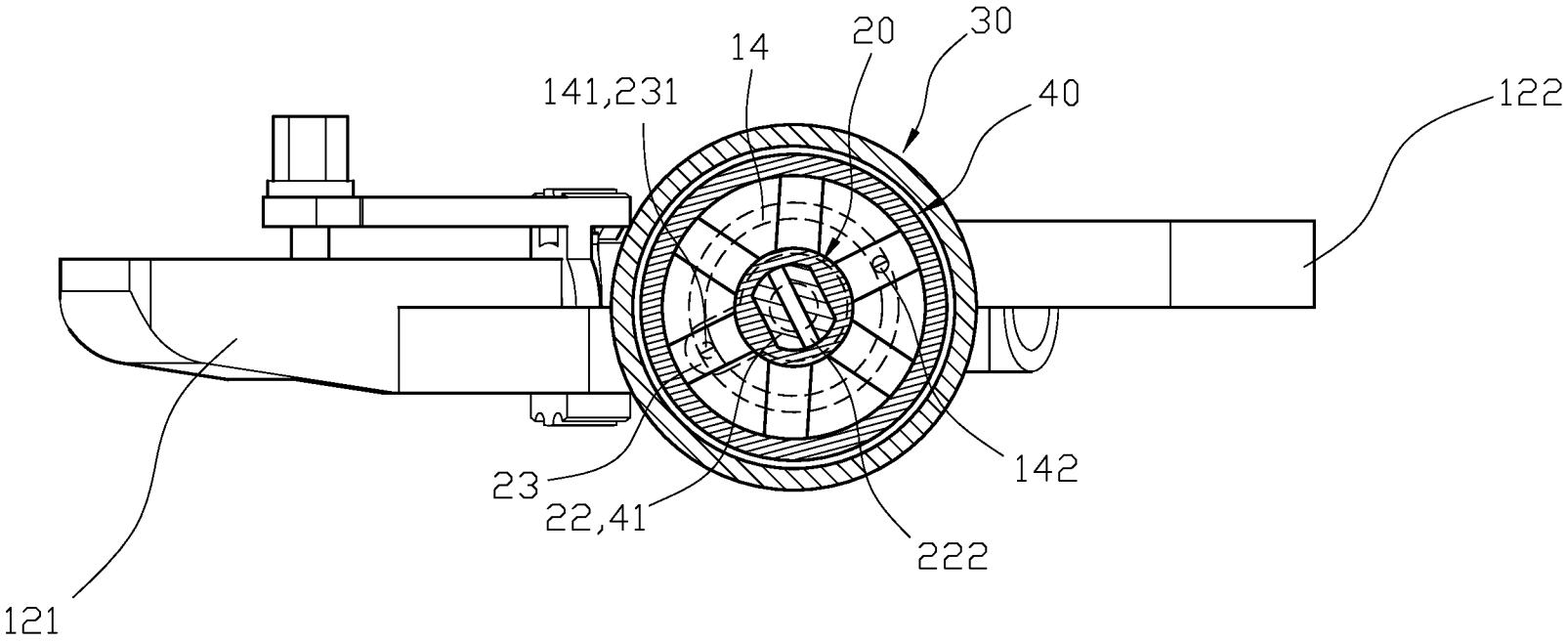
FIG. 5 illustrates a sectional view along A-A' direction in FIG. 4 in the present invention.
Figure 6:
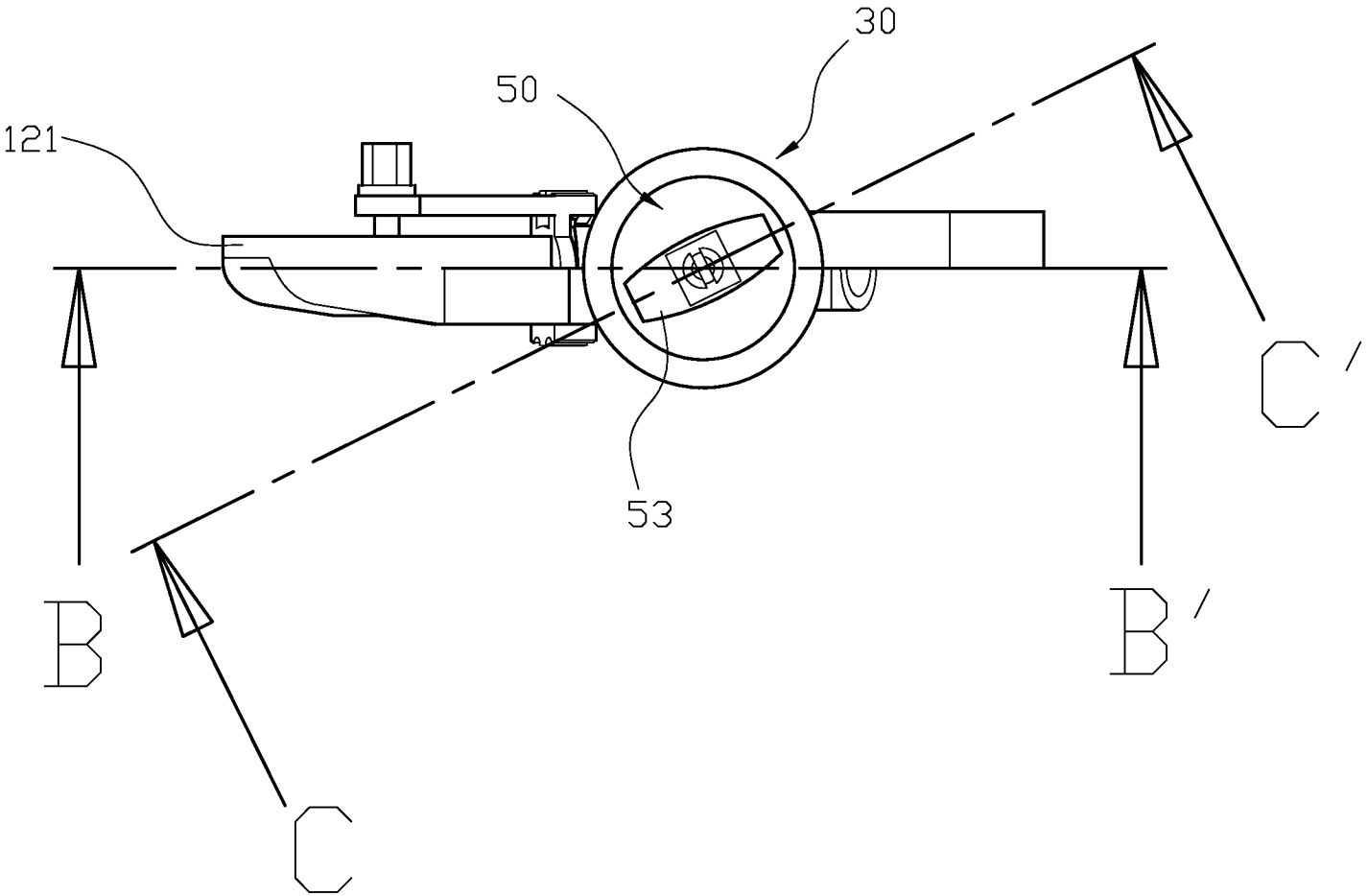
FIG. 6 illustrates another two-dimensional schematic view in the present invention.

In order to further understand the goal, characteristics and effect of the present invention, a number of embodiments along with the drawings are illustrated as following:

Referring to FIGS. 1 to 3, a swing sprinkler has a main body (10), a driving unit (20), a cover body (30), an inner plate (40) and an action unit (50). A space (11) is formed at an upper portion of the main body (10), and a swing space (111) that is empty is formed on both sides of the space (11). A positioning protruding portion (112) is protrudingly formed at a center of the space (11) corresponding to a swing unit (12). A water contacting arm (121) and a balancing arm (122) extend from both sides of the swing unit (12), and penetrate from both sides of the swing space (111) of the space (11), and form a secured positioning at the positioning protruding portion (112) through the center of a bottom portion of the swing unit (12). A ring portion (13) is formed at an upper portion of the space (11), and a positioning slot (131) is formed on both sides of the ring portion (13) and facing each other. A center axis (123) is protrudingly formed at a center portion of the swing unit (12), and a positioning hole (124) is formed one side of the center axis (123). A resilient unit (14) is disposed on the center axis (123), and an upper positioning stick (141) and a lower positioning stick (142) are protrudingly formed at an upper and lower portion of the resilient unit (14), and the lower positioning stick (142) passes through the positioning hole (124). A protruding portion (21) is formed at a bottom portion of the driving unit (20) and engaged with the center axis (123) of the swing unit (12). A non-circular connecting stick (22) extends from an upper portion of the driving unit (20), and a cone-shaped protruding end (221) is protrudingly formed at an upper portion of the connecting stick (22), and a resilient gap (222) is formed from the protruding end (221) at the upper portion to the lower portion of the connecting stick (22). A connecting board (23) extends from one side of the driving unit (20), and a fixed hole (231) is formed through the connecting board (23) to form a secured positioning with the upper positioning stick (141) of the resilient unit (14). A cover body (30) covers the ring portion (13) of the upper portion of the space (11), and a wedging protruding block (31) is formed on both sides of the inner wall of the positioning slot (131) on both sides of the ring portion (13). A receiving space (32) is recessedly formed at the upper portion of the cover body (30), and a through hole (321) is formed and provided for the connecting stick (22) of the driving unit (20) to pass through. Also, a plurality of positioning protruding ribs (322) are formed at an outer periphery of an inner bottom surface of the cover body. The inner plate (40) is disposed in the receiving space (32) on top of the cover body (30), and a center portion of the inner plate (40) has a non-circular through opening (41) that is disposed onto the connecting stick (22) of the driving unit (20). A plurality of restricting protruding ribs (42) are formed at the periphery of the bottom portion of the inner plate (40), disposed between the positioning protruding ribs (322) of the receiving space (32), and a protruding unit (43) is protrudingly formed on both sides of the upper portion of the inner plate (40). The action unit (50) is disposed on top of the cover body (30), and a non-circular positioning trough (51) is recessedly formed at a center portion of the action unit (50), and a wedging hole (511) is formed and through upwards. A ring-shaped protruding rib (52) is formed at the bottom portion of the action unit (50), and the ring-shaped protruding rib (52) includes a recessed slot (521) corresponding to the protruding unit (43) of the inner plate (40). Also, a button-shaped protruding block (53) is formed on an upper end of the action unit (50).

Referring to FIGS. 2 to 8 for the structure of the present invention, the swing unit (12) is disposed in the space (11) of the main body (10), and forms a secured positioning from the center of the bottom with the positioning protruding portion (112) of the space (11). The water contacting arm (121) and a balancing arm (122) extend from both sides of the swing unit (12), penetrating from both sides of the swing space (111) of the space (11). The resilient unit (14) is disposed onto the center axis (123) of the swing unit (12), and the lower positioning stick (142) plugs into the positioning hole (124). The protruding portion (21) located at the bottom portion of the driving unit (20) engages with the center axis (123) of the swing unit (12) to form a secured positioning, and the fixed hole (231) of the connecting board (23) connects with the upper positioning stick (141) of the resilient unit (14). The cover body (30) is disposed at the ring portion (13) of the upper portion of the space (11), and the protruding block (31) located at the inner wall of the cover body (30) engages with the positioning slot (131) of the ring portion (13) to form a secured positioning, and the through hole (321) is provided for the connecting stick (22) of the driving unit (20) to penetrate through. The inner plate (40) is disposed at the receiving space (32) at the upper portion of the cover body (30), and the inner plate (40) connects with the connecting stick (22) of the driving unit (20) with the through opening (41), so that the restricting protruding ribs (42) at the periphery of the bottom portion engage with the positioning protruding ribs (322) of the receiving space (32) to form a secured positioning. The action unit (50) is disposed at the upper portion of the receiving space (32) of the cover body (30), and the action unit (50)

is disposed onto the connecting stick (22) of the driving unit (20) through the positioning trough (51) at the center, so that protruding end (221) passes through the wedging hole (511) to connect and form a secured positioning, as well as the engagement between the recessed slot (521) of the ring-shaped protruding rib (52) and the protruding unit (43) of the inner plate (40). According to the structure stated above, a swing sprinkler is obtained.

Figure 7:
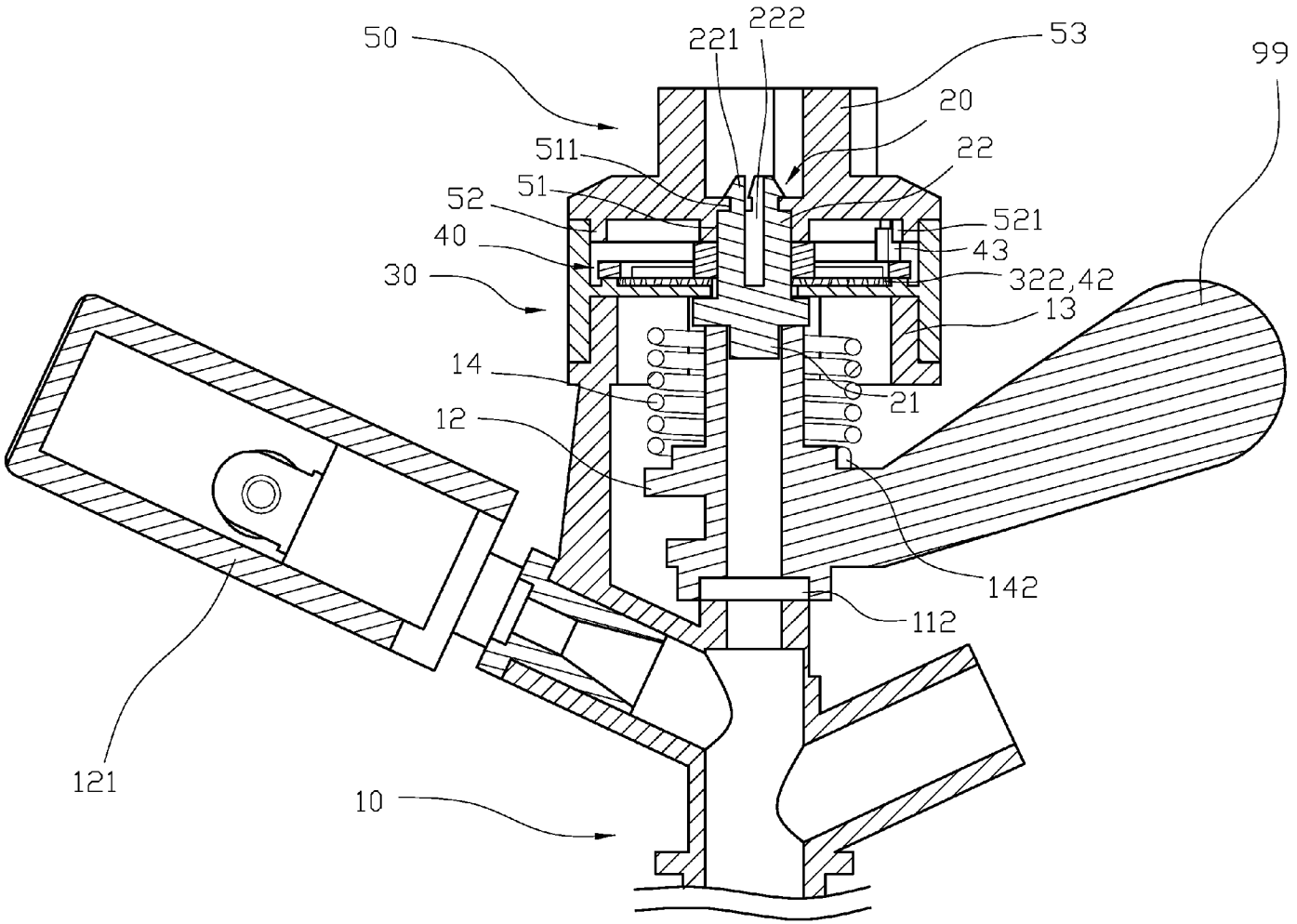
FIG. 7 illustrates a schematic view along B-B' direction in FIG. 6 in the present invention.
Figure 8:
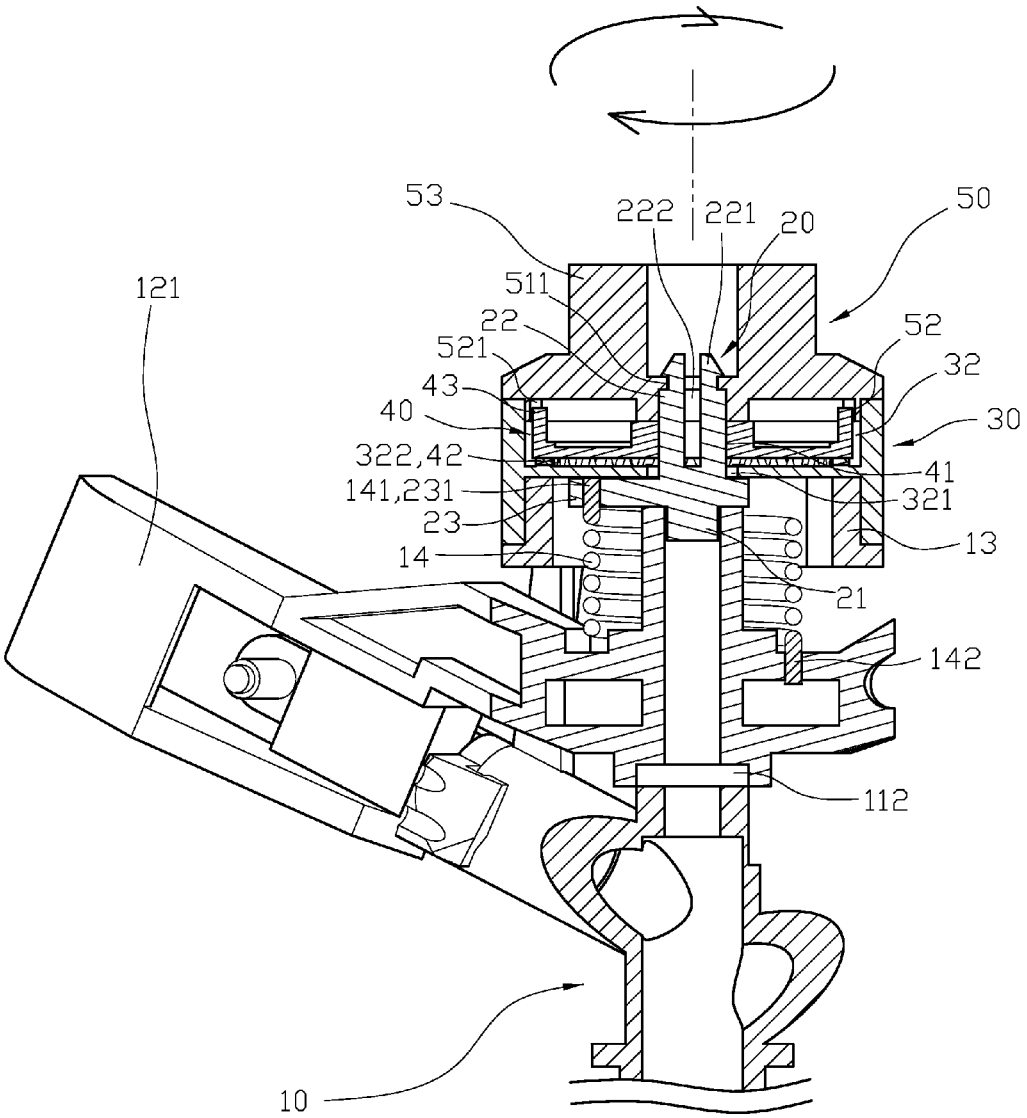
FIG. 8 illustrates a schematic view along C-C' direction in FIG. 6 in the present invention.

Referring to FIGS. 7 and 8 for practical use of the present invention, the main body (10) is connected with the water source, and the water strikes the water contacting arm (121) of the swing unit (12) to achieve the goal of water spraying. The swing unit (12) has a resilient unit (14), so that when the water contacting arm (121) of the swing unit (12) was struck by water, it can restore to its original position using the resilient force provided by the resilient unit (14) to effectively spray in a circular area. Also, one end of the resilient unit (14) of the main body (10) is fixed at the swing unit (12), and the other end is connected with the driving unit (20) that passes through the through hole (321) of the cover body (30), the inner plate (40) and the action unit (50) via the connecting stick (22). When the main body (10) has been used for a certain period of time, the resilient unit (14) may be fatigue or if the user wants to adjust the tightness of the swing unit (12), the user can directly rotate the action unit (50) to drive the driving unit (20) and the inner plate (40), so that the driving unit (20) would rotate around the connecting stick (22) and the resilient unit (14) can be adjusted and tightened through the connecting board (23). During the process of using the driving unit (20) to adjust the resilient unit (14), the inner plate (40) is driven by the action unit (50) to rotate in the receiving space (32) of the cover body (30), and the restricting protruding ribs (42) at the periphery of the bottom portion engage with the positioning protruding ribs (322) of the receiving space (32), so once the action unit (50) stops the action of adjustment, the restricting protruding ribs (42) of the inner plate (40) engage with the positioning protruding ribs (322) of the receiving space (32) to form a secured positioning and restrict the driving unit (20) to prevent the resilient unit (14) from escaping to achieve the goal of adjusting the tightness of the resilient unit (14). Also, the rebounding speed of the swing unit (12) can be adjusted to further adjust the status of the sprinkler to increase the practicability and convenience.

According to the embodiments discussed above, the present invention is advantageous that the main body (10) has a structure to adjust the tightness of the resilient unit (14) and the rebounding speed of the swing unit (12) according to the status of the sprinkler, so when the water strikes the swing unit, the water spraying status can be adjusted to either concentrated or scattered. Furthermore, when the adjustment takes place, it can be achieved by merely rotating the action unit (50) of the main body (10) to simultaneously drive the inner plate (40) to use the restricting protruding ribs (42) to engage with positioning protruding ribs (322) of the receiving space (32) to form a secured positioning to prevent the resilient unit (14) from rewinding after adjustment to achieve the goal of effectively adjusting the tightness of the resilient unit (14) and the rebounding speed of the swing unit (12). Therefore, the spraying status of the sprinkler has more variabilities, and the sprinkler is more practical and convenient to use.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A swing sprinkler, comprising:

a main body, having a space at an upper portion thereof, and a swing unit, wherein a ring portion is formed at an upper portion of the space, and a positioning slot is formed on both sides of the ring portion and facing each other, wherein a center axis is protrudingly formed at a center portion of the swing unit, and a positioning hole is formed one side of the center axis, wherein a resilient unit is disposed on the center axis, and an upper positioning stick and a lower positioning stick are protrudingly formed at an upper and lower portion of the resilient unit, and the lower positioning stick passes through the positioning hole;

a driving unit, having a protruding portion at a bottom portion thereof, engaging with the center axis of the swing unit, wherein a non-circular connecting stick extends from an upper portion of the driving unit, and a cone-shaped protruding end is protrudingly formed at an upper portion of the connecting stick, and a resilient gap is formed from the protruding end at the upper portion to the lower portion of the connecting stick, wherein a connecting board extends from one side of the driving unit, and a fixed hole is formed through the connecting board to form a secured positioning with the upper positioning stick of the resilient unit;

a cover body, covering the ring portion of the upper portion of the space, and a wedging protruding block formed on both sides of the inner wall of the positioning slot on both sides of the ring portion, wherein a receiving space is recessedly formed at the upper portion of the cover body, and a through hole is formed and provided for the connecting stick of the driving unit to protrudingly pass through, and a plurality of positioning protruding ribs are formed at an outer periphery of an inner bottom surface of the cover body;

an inner plate, disposed in the receiving space at an upper portion of the cover body, wherein a center portion of the inner plate has a non-circular through opening that is disposed onto the connecting stick of the driving unit, and a plurality of restricting protruding ribs are formed at periphery of a bottom portion of the inner plate, disposed between the positioning protruding ribs of the receiving space; and an action unit, disposed at an upper portion of the cover body, and a non-circular positioning trough recessedly formed at a center portion of the action unit, and a wedging hole formed and through upwards, wherein when the action unit is connected with the cover body, the positioning trough is disposed onto the connecting stick of the driving unit, so that the protruding end passes through the wedging hole to connect with each other and form a secured positioning.

2. The swing sprinkler of claim 1, wherein a positioning protruding portion is protrudingly formed at a center portion of the space, and a center of a bottom portion of the swing unit is disposed onto the positioning protruding portion to form a secured positioning.

3. The swing sprinkler of claim 1, wherein a swing space that is empty is formed on both sides of the space, and a water contacting arm and a balancing arm extend from both sides of the swing unit, penetrating from both sides of the swing space of the space.

4. The swing sprinkler of claim 1, wherein a protruding unit is protrudingly formed on both sides of an upper portion of the inner plate, and a ring-shaped protruding rib is formed at the bottom portion of the action unit, and the ring-shaped protruding rib includes a recessed slot corresponding to the protruding unit of the inner plate, and when the action unit is disposed at an upper portion of the cover body, the recessed slot of the ring-shaped protruding rib engages and connects with the protruding unit of the inner plate.

5. The swing sprinkler of claim 1, wherein a button-shaped protruding block is formed on an upper end of the action unit.

* * * * *